United States Patent [19]

Jackson et al.

[11] Patent Number: 4,462,310

[45] Date of Patent: Jul. 31, 1984

[54] COMPACTING DEVICE

[76] Inventors: O. L. Jackson, P.O. Box 1627; Noah F. Graham, 16424 Powell Rd., both of Brooksville, Fla. 33512

[21] Appl. No.: 451,913

[22] Filed: Dec. 21, 1982

[51] Int. Cl.[3] ..... B30B 15/00

[52] U.S. Cl. ..... 100/219; 217/86; 220/326

[58] Field of Search ..... 100/219, 220, 54, 56, 100/57, 59, 187; 217/86

[56] References Cited

U.S. PATENT DOCUMENTS

| | | | |
|---|---|---|---|
| 176,135 | 4/1876 | Herbert | 100/220 |
| 548,724 | 10/1895 | Rushton | 100/219 X |
| 1,242,232 | 10/1917 | Palm | 100/219 |
| 1,448,779 | 3/1923 | Vowell | 217/86 |
| 1,624,808 | 4/1927 | Scholten | 100/219 X |
| 1,852,195 | 4/1932 | Shaw | 100/219 X |
| 2,399,857 | 5/1946 | Connors | 100/219 |
| 3,039,382 | 6/1962 | Simon | 100/219 |

*Primary Examiner*—Billy J. Wilhite

*Attorney, Agent, or Firm*—Sughrue, Mion, Zinn, Macpeak and Seas

[57] ABSTRACT

A compacting device adapted to be inserted into a barrel or similar container is provided with a base member having a plurality of upstanding rods secured to the base member in equally spaced relation about the periphery thereof. A support ring surrounds the upper ends of the rods, with each rod being secured to the interior surface of the ring. One or more compacting plates are provided which are adapted to fit within the ring for movement in a direction parallel to the rods. A plurality of spring locking plates equal in number to the rods are secured to the upper surface of the compacting plates for engagement with the rods which are provided with threads along substantially the entire length thereof. Thus, when loose material is placed in the container, and a compacting disc is inserted into the compacting device and pressed downwardly by any suitable press or the like, the material within the container will be compacted. The engagement of the locking plates with the threaded rods prevents the reverse movement of the compacting plate so that upon withdrawal of the press additional material can be added to the container for subsequent compaction.

6 Claims, 4 Drawing Figures

COMPACTING DEVICE

BACKGROUND OF THE INVENTION

The present invention is directed to a compacting device, more specifically to a compacting device adapted to be inserted in a container wherein one or more plates are secured at various levels to the compacting device within the container to prevent the compacted material from rebounding subsequent to compression thereby permitting the introduction of additional material for compaction.

In the packing of loose material into a container such as a barrel or a drum, a plunger or some other type compacting ram is utilized to compress the material into the container. However, upon withdrawal of the plunger to permit the introduction of additional material the loose material previously compacted tends to spring back due to its own natural inherent resiliency and thereby limits the amount of additional material which can be added to the container. In order to increase the capacity of a container, it has been known in the past to insert spikes or pins through the sides of the container into the compacted material adjacent the plunger while the material is in the fully compacted condition. Upon withdrawal of the plunger to permit the introduction of additional material, the spikes will hold the previously compressed material in the compressed condition thereby substantially increasing the capacity of the container. As the container is gradually filled the spikes are moved upwardly depending on the depth of the compressed material. Once the container is completely filled with compressed material, a cover member may be secured to the container and the spikes can be removed.

An example of such a prior art arrangement as described above can be found in the U.S. Pat. No. 176,135, to Herbert, directed to a Tobacco Press. In the tobacco press of this patent, a screw press is used for compacting tobacco within a hogshead and each successive charge of tobacco is held in the compressed condition by the insertion of pins through the staves between the screw press follower and the tobacco to hold the tobacco compacted upon withdrawal of the screw press follower to allow the insertion of additional tobacco. The pins are connected to the base plate by means of an adjustable chain so that the pins can be moved upwardly as the hogshead is filled with each successive charge.

The use of spikes or pins extending through the side of the container to temporarily restrain the compacted material within the container is limited for use with particular materials. The provision of pins provides only limited contact with the compacted material and, depending upon the nature of the material, the material could expand or rebound past the pin. Also, if the material being compressed must be compacted in a sealed container, the provision of openings through the side of the container for the insertion of pins would be objectionable.

SUMMARY OF THE INVENTION

The present invention provides a new and improved compacting device which overcomes all of the drawbacks of the aforementioned prior art compacting devices.

The present invention provides a new and improved compacting device which is economical to construct and which efficiently compacts the material over substantially the entire surface thereof while maintaining the integrity of the container into which the material is being compacted.

The present invention provides a new and improved compacting device comprising a base member adapted to be inserted into a container open at one end and having a peripheral configuration complementary to the cross-sectional configuration of the container, a plurality of threaded rods secured in spaced locations to the periphery of said base member and adapted to extend upwardly into proximity to the open end of the container, a supporting band secured to the ends of said rods opposite said base member and having a configuration complementary to the periphery of said base member, at least one intermediate plate having a peripheral configuration substantially the same as said base member adapted to be disposed between said rods parallel to said base member and locking means secured to said intermediate plate and disposed in engagement with said rods to allow movement of said intermediate plate toward said base member while preventing movement of said plate in the opposite direction.

The foregoing and other objects, features, and advantages of the invention will be apparent in the following more particular description of the preferred embodiment of the invention as illustrated in the accompanying drawings.

DETAILED DESCRIPTION OF THE INVENTION

The compacting device according to the present invention may be utilized with any suitable container into which loose bulk material is adapted to be compacted. While the container may be a rectilinear box, a wooden barrel, or any other suitable container, the compacting device will be described in cooperation with a standard fifty-five gallon steel drum which is suitable for the disposal of hazardous materials or materials having a substantial amount of liquid associated therewith since a cover member may be securely welded to the open end of the container subsequent to the filling of the container.

Figure 1:
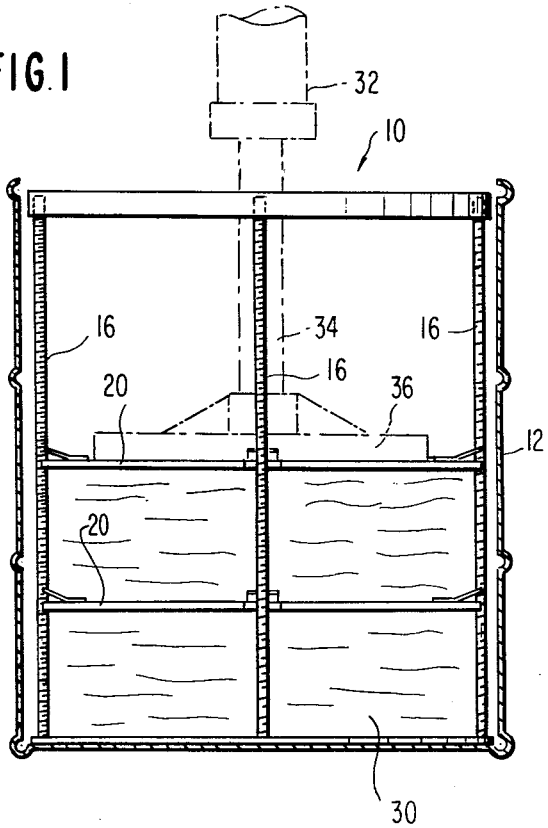
FIG. 1 is a side elevation view of the compacting device according to the present invention located in a cylindrical drum which is shown in section with a press for compacting material within the drum shown in phantom lines.
Figure 2:
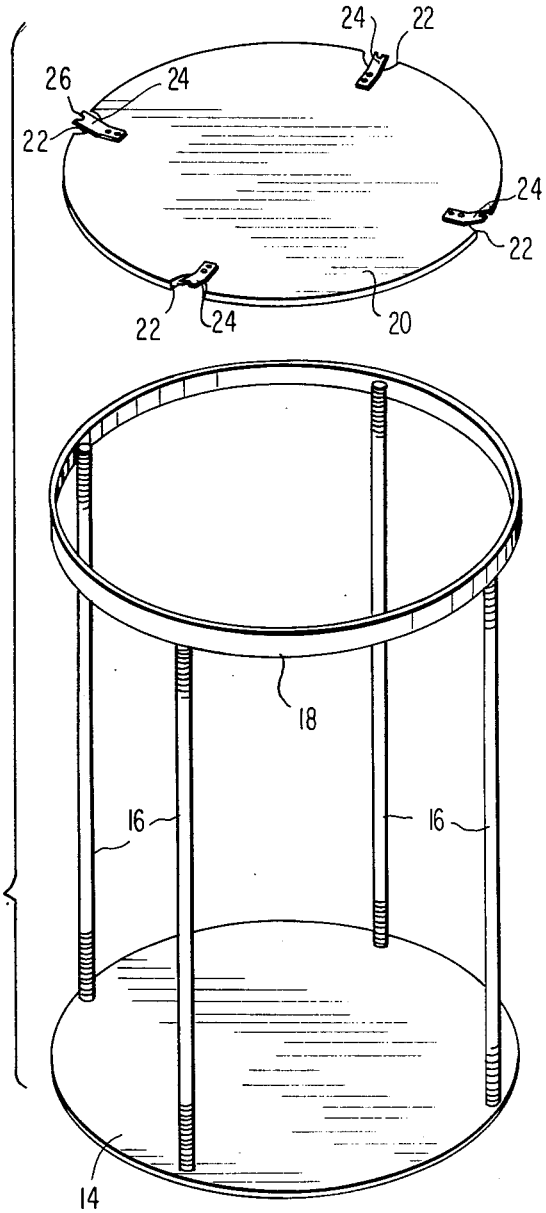
FIG. 2 is an exploded view of the compacting device according to the present invention showing two intermediate discs for cooperation with the rods of the framework of the compacting device.
Figure 3:
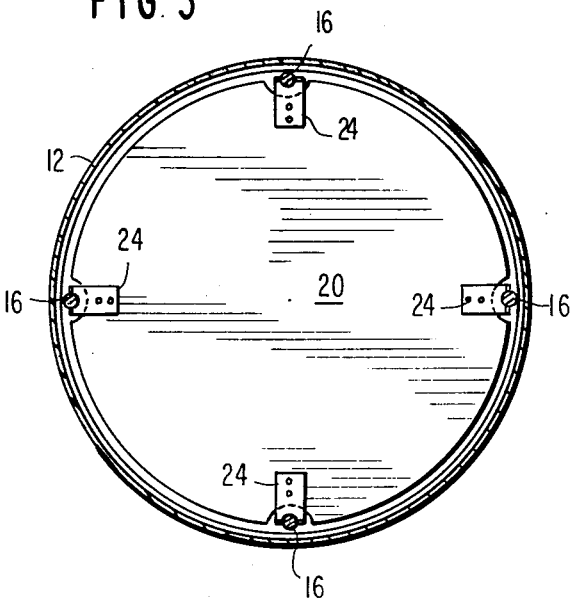
FIG. 3 is a sectional view showing an intermediate plate disposed within a cylindrical drum in locking engagement with the rods of the framework of the compacting device.
Figure 4:
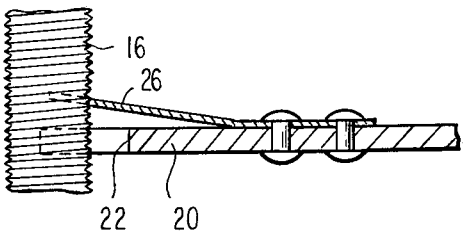
FIG. 4 is an enlarged cross-section of a detailed view showing the cooperaton of the locking device on the intermedite member with a threaded rod of the compacting device.

As best seen in FIG. 1, the compacting device 10 according to the present invention is dimensioned to fit closely within the cylindrical walls of the steel drum 12 and extends from the bottom of the drum 12 to the open end thereof, leaving only the necessary clearance for the securement of a cover to the open end of the drum. The compacting device 10 is comprised of a circular base plate 14 of any suitable strong, rigid material such as steel or the like. Four, equally spaced, threaded steel rods 16 are secured in equally spaced relation to the base plate 14 by any suitable means adjacent the periphery thereof. The steel rods 16 can be threaded into complementary threaded apertures in the base plate or may be welded directly to the surface of the base plate. A steel support ring 18 having outer dimensions substantially identical to the outer dimensions of the base plate 14 surrounds the upper ends of the threaded rods 16 which are secured to the inner surface of the ring 18 by any suitable means such as welding or the like. The frame of the compacting device shown in FIG. 2 is adapted to fit closely within the drum as best seen in FIG. 1.

A plurality of compacting discs 20 of any suitable, strong, rigid material are each provided with a plurality of notches 22 in the periphery thereof equal in number to the number of rods 16. The notches 22 are dimensioned so as to fit closely about the rods 16 without contacting the same when the disc is inserted into the frame of the compacting device. Four spring metal locking plates 24 are secured to the upper surface of the disc 20 adjacent each notch 22 by welding, rivets, screws or any other suitable fastening means. The locking plates are each provided with a free end which is bent upwardly at an acute angle relative to the plane of the disc 20 in overlying relation to a respective notch 22. The free end of each spring locking plate 24 is provided with a notch 26 having a curvature substantially complementary to the cylindrical threaded rods 16 so as to engage the respective rod between adjacent threads on the rod.

In the operation of the compacting device, which is best seen in FIG. 1, the compacting device 10 is inserted in a drum 12 and filled with a mass of material 30 to be compacted within the drum. Due to the looseness of the material 30, the material will substantially fill the drum initially. A first compacting disc 20 is then placed within the compacting device and pressed down manually until the locking tabs engage the threads on the rods 16. The drum is placed within a press which might be of the type having a hydraulic cylinder 32 and a reciprocating plunger 34 having a pressure head 36 secured to the lower end thereof. Upon operation of the hydraulic piston and cylinder assembly, the compacting plate 20 will be forced downwardly to compact the material 30 to the greatest possible extent. Assuming the material 30 between the base plate 14 and the first disc 20, as illustrated in FIG. 1, is fully compacted, the plunger 30 is withdrawn from the drum 12 to permit the introduction of additional material 30 into the drum on top of the first compacting disc 20 which will remain in the position shown in FIG. 1 to prevent the previously compacted material from rebounding or expanding. A seconding compacting disc 20 is then placed in the compacting device 10 and forced downwardly by the hydraulic piston and cylinder assembly to compact the additional material. Depending upon the nature of the material, any number of compacting discs may be employed, with the last compacting disc engaging the threaded rods 16 adjacent the upward ends thereof. A cover (not shown) can then be secured to the upper end of the drum 12 by any suitable means such as welding or the like.

Due to the nature of the spring locking tabs and the manner in which they cooperate with the threaded rods 16 it is virtually impossible to withdraw the compacting discs 20 from the compacting device without the destruction of the same. Therefore, the compacting device according to the present invention is primarily suitable for use with materials which are to be permanently disposed of. However, if the spring locking plates 24 are detachably secured to the compacting plates 20 by screws or other suitable means, the spring locking plates 24 can readily be separated from the plates 20 to permit removal of the plate or plates from the compacting device to allow removal of the compacted material. It is obvious that the dimensions of the container can vary widely and therefore the dimensions of the compacting device would vary accordingly. The compacting device may be made of any suitable strong, rigid material and the bottom plate could be replaced by a ring such as the ring 18. The simple, inexpensive construction of the compacting device lends itself to a disposable waste situation wherein the compacting device would not be reusable.

While the invention has been particularly shown and described in reference to a preferred embodiment thereof, it will be understood by those in the art that various changes in form and detail can be made therein without departing from the spirit and scope of the invention.

What is claimed is:

1. A compacting device of the type adapted to be closely fitted within a container for compacting material within the container and maintaining the material in compacted condition comprising a base member having a peripheral configuration complementary to the cross-sectional dimensions of the container and adapted to be placed at the bottom of the container, a plurality of threaded rods disposed perpendicular to said base member and secured at one end to said base member adjacent the periphery thereof in substantially equally spaced relation, a retaining member having a peripheral configuration substantially identical to the peripheral configuration of the base member extending about said rods and secured to the opposite ends of said rods, at least one compacting plate having a peripheral configuration similar to the peripheral configuration of said base member and adapted to fit within said rods perpendicular thereto, and locking means secured to said compacting plate and disposed in engagement with said threaded rods to permit movement of said compacting plate towards said base member while preventing movement of said compacting plate in the opposite direction.

2. A compacting device as set forth in claim 1 wherein said locking means is comprised of a plurality of resilient locking plates equal in number to said rods and secured to the upper surface of said compacting plate at one end with the other end thereof in engagement with a respective threaded rod.

3. A compacting device as set forth in claim 2 wherein said locking plates are permanently secured to said compacting plate.

4. A compacting device as set forth in claim 1 further comprising at least one additional compacting plates for compacting and holding additional material in the compacted condition in a plurality of layers.

5. A compacting device as set forth in claim 1 wherein said base member and said compacting plate are discs of strong, rigid material adapted to closely fit within a cylindrical barrel and said retaining member is in the form of a ring having a diameter greater than the diameter of said compacting plate.

6. A compacting device as set forth in claim 5 wherein four rods are provided with each rod being threaded along substantially the entire length thereof.

* * * * *